US010935928B2

(12) United States Patent
Endo

(10) Patent No.: US 10,935,928 B2
(45) Date of Patent: Mar. 2, 2021

(54) CARTRIDGE

(71) Applicant: CANON KABUSHIKI KAISHA, Tokyo (JP)

(72) Inventor: Atsushi Endo, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/695,742

(22) Filed: Nov. 26, 2019

(65) Prior Publication Data

US 2020/0096938 A1 Mar. 26, 2020

Related U.S. Application Data

(63) Continuation of application No. PCT/JP2018/021106, filed on Jun. 1, 2018.

(30) Foreign Application Priority Data

Jun. 5, 2017 (JP) ..... JP2017-110855

(51) Int. Cl.
*G03G 21/18* (2006.01)
*G03G 21/16* (2006.01)

(52) U.S. Cl.
CPC ..... *G03G 21/1885* (2013.01); *G03G 21/1647* (2013.01); *G03G 21/1652* (2013.01);
(Continued)

(58) Field of Classification Search
CPC ..... G03G 2221/1684; G03G 21/1821; G03G 21/1676; G03G 21/1814
See application file for complete search history.

(56) References Cited

U.S. PATENT DOCUMENTS 5,926,666 A * 7/1999 Miura ..... G03G 21/1885 399/25
7,840,154 B2 * 11/2010 Ishii ..... G03G 15/80 399/90

(Continued)

FOREIGN PATENT DOCUMENTS

JP 2012-022333 A 2/2012
JP 2015-058534 A 3/2015

(Continued)

OTHER PUBLICATIONS

International Search Report and Written Opinion for International Patent Application No. PCT/JP2018/021106, dated Dec. 13, 2018.

*Primary Examiner* — Walter L Lindsay, Jr.
*Assistant Examiner* — Jessica L Eley
(74) *Attorney, Agent, or Firm* — Venable LLP

(57) ABSTRACT

A cartridge removably attachable to an image forming apparatus, including a resin-made casing, a planar memory chip configured to store information to be outputted to the image forming apparatus, a recess portion provided on an outer surface of the casing to fit the memory chip, and a regulating portion formed integrally with the casing and provided to project out of the outer surface of the casing in a direction intersecting with a surface of the memory chip to regulate a move of the memory chip in the direction intersecting with the surface of the memory chip, wherein the memory chip is attached to the recess portion in a condition of displaceable within the recess portion in a posture substantially surrounded by side wall of the recess portion.

20 Claims, 14 Drawing Sheets

(52) U.S. Cl.
CPC . *G03G 21/1814* (2013.01); *G03G 2221/1654* (2013.01); *G03G 2221/1823* (2013.01)

(56) References Cited

U.S. PATENT DOCUMENTS

| | | | | |
|---|---|---|---|---|
| 2002/0025186 | A1* | 2/2002 | Karakama ..... | G03G 21/1882 399/111 |
| 2005/0078978 | A1* | 4/2005 | Suzuki ..... | G03G 21/1814 399/111 |
| 2008/0170866 | A1 | 7/2008 | Thacker et al. | |
| 2012/0200871 | A1 | 8/2012 | Takahashi et al. | |
| 2015/0055963 | A1* | 2/2015 | Kanno ..... | G03G 21/1892 399/12 |
| 2015/0077478 | A1 | 3/2015 | Kawabata et al. | |
| 2017/0075297 | A1 | 3/2017 | Eto | |

FOREIGN PATENT DOCUMENTS

| | | | |
|---|---|---|---|
| JP | 2016-128933 | A | 7/2016 |
| JP | 2017-054022 | A | 3/2017 |

* cited by examiner

CARTRIDGE

CROSS-REFERENCE TO RELATED APPLICATIONS

This application is a Continuation of International Patent Application No. PCT/JP2018/021106, filed Jun. 1, 2018, which claims the benefit of Japanese Patent Application No. 2017-110855, filed Jun. 5, 2017, both of which are hereby incorporated by reference herein in their entirety.

BACKGROUND OF THE INVENTION

Field of the Invention

The present invention relates to a removable cartridge applicable to an electro-photographic or electrostatic recording image forming apparatus.

Description of the Related Art

Hitherto, an image forming apparatus adopting an electrophotographic system visualizes an image by developing an electrostatic latent image formed on an image bearing member such as a photosensitive drum by resin and others containing coloring matters and others. For such image forming apparatus, consumable cartridges such as a drum cartridge, a developer cartridge and a toner cartridge that are configured to be removably attached to an apparatus body are widely adopted as what a user can replace by oneself. It is essential for the consumable cartridges to be able to communicate information such as date of manufacture and a lot number of the cartridge for example between the cartridge and the apparatus body in order to maintain quality of the apparatus body.

As means for communicating information between the cartridge and the apparatus body, a memory-side contact portion of a memory provided in the consumable cartridge and a body-side contact portion provided in the apparatus body are widely used. In this case, the memory-side contact portion contacts with the body-side contact portion, thus becoming conductive, when the consumable cartridge is attached to the apparatus body, and the communication of the information is conducted as the memory is connected with a control unit provided in the apparatus body through the memory-side contact portion and the body-side contact portion.

Here, there is a possibility of causing the following trouble by the contact type information exchange made between the apparatus body and the memory provided in the cartridge. That is, during the memory-side contact portion is in contact with the body-side contact portion, there is a case where the contact is affected by vibrations generated by operations such as rotation of the cartridge itself and minute backlash generated between the cartridge retained in the apparatus body and the apparatus body. Then, there is a possibility of causing flaws on a surface of the contact portion due to friction of the contact portions and of thus causing contact failures.

In order to suppress such contact failures from being generated, there is proposed a retaining member for retaining the memory and a cartridge in which the memory is removably attached to the cartridge by the retaining member (Japanese Patent Application Laid-open No. 2016-128933). According to this cartridge, the memory retained by the retaining member is retained movably in a direction orthogonal to a contact point with respect to the cartridge to stabilize the contact by preventing friction otherwise occurring between the contact portions. This arrangement makes it possible to realize a stable contact that is hardly influenced by flaws otherwise generated by the vibrations generated by the operations of the cartridge itself and the friction of the contact portions caused by the operations of the cartridge itself.

However, the cartridge described in Japanese Patent Application Laid-open No. 2016-128933 requires to provide the retaining member for retaining the memory anew, a number of component parts increases.

SUMMARY OF THE INVENTION

According to one aspect of the present invention, a cartridge removably attachable to an image forming apparatus, includes a resin-made casing, a planar memory chip configured to store information to be outputted to the image forming apparatus, a recess portion provided on an outer surface of the casing to fit the memory chip, and a regulating portion formed integrally with the casing and provided to project out of the outer surface of the casing in a direction intersecting with a surface of the memory chip to regulate a move of the memory chip in the direction intersecting with the surface of the memory chip, wherein the memory chip is attached to the recess portion in a condition of displaceable within the recess portion in a posture substantially surrounded by side wall of the recess portion.

According to one aspect of the present invention, a cartridge removably attachable to an image forming apparatus, includes a resin-made casing, a planar memory chip configured to store information to be outputted to the image forming apparatus, a retaining portion provided on an outer surface of the casing and formed integrally with the casing to regulate the memory chip from moving in a surface direction of the memory chip and to retain the memory chip, and a rod shape project portion formed integrally with the casing and provided to project out of the outer surface of the casing, wherein a part of the rod shape project portion overlaps with the memory chip when viewed from a direction orthogonal to a surface of the memory chip.

According to one aspect of the present invention, a cartridge removably attachable to an image forming apparatus, includes a resin-made casing, a planar memory chip configured to store information to be outputted to the image forming apparatus, a retaining portion provided on an outer surface of the casing and formed integrally with the casing to fit the memory chip and to retain the memory chip, and a regulating portion formed integrally with the casing and provided to project out of the outer surface of the casing to regulate a move of the memory chip in a direction intersecting with a surface of the memory chip, wherein the regulating portion is processed and formed by thermal deformation after the memory chip is attached to the retaining portion.

Further features of the present invention will become apparent from the following description of exemplary embodiments with reference to the attached drawings.

DESCRIPTION OF THE EMBODIMENTS

An image forming apparatus 1 of an embodiment will be described in detail below with reference to FIGS. 1 through 14. Note that a case of applying a drum cartridge 80 to a tandem type full-color printer will be described as one example of the image forming apparatus 1 using the drum cartridge 80. However, a cartridge is not limited only to the cartridge applied to the tandem type image forming apparatus and may be also a cartridge applied to another type image forming apparatus. It is also not limited only to a full-color but may be also a monochrome or mono-color. Or, it may be carried out in various uses such as a printer, various printing machines, a copier, a facsimile machine and a multi-function printer by adding a necessary device, equipment or a casing structure. Still further, according to the present embodiment, the image forming apparatus 1 adopts a system including an intermediate transfer belt 44*b* and secondarily and collectively transferring a composite toner image of respective colors to a sheet S after primarily transferring toner images of each color from photosensitive drums 81 to the intermediate transfer belt 44*b*. However, the present disclosure is not limited to such system and may adopt a system of directly transferring toner images from photosensitive drums to a sheet conveyed by a sheet conveyor belt. Still further, a two-component developer composed of non-magnetic toner and magnetic carrier is used as the developer in the present embodiment.

Figure 1:
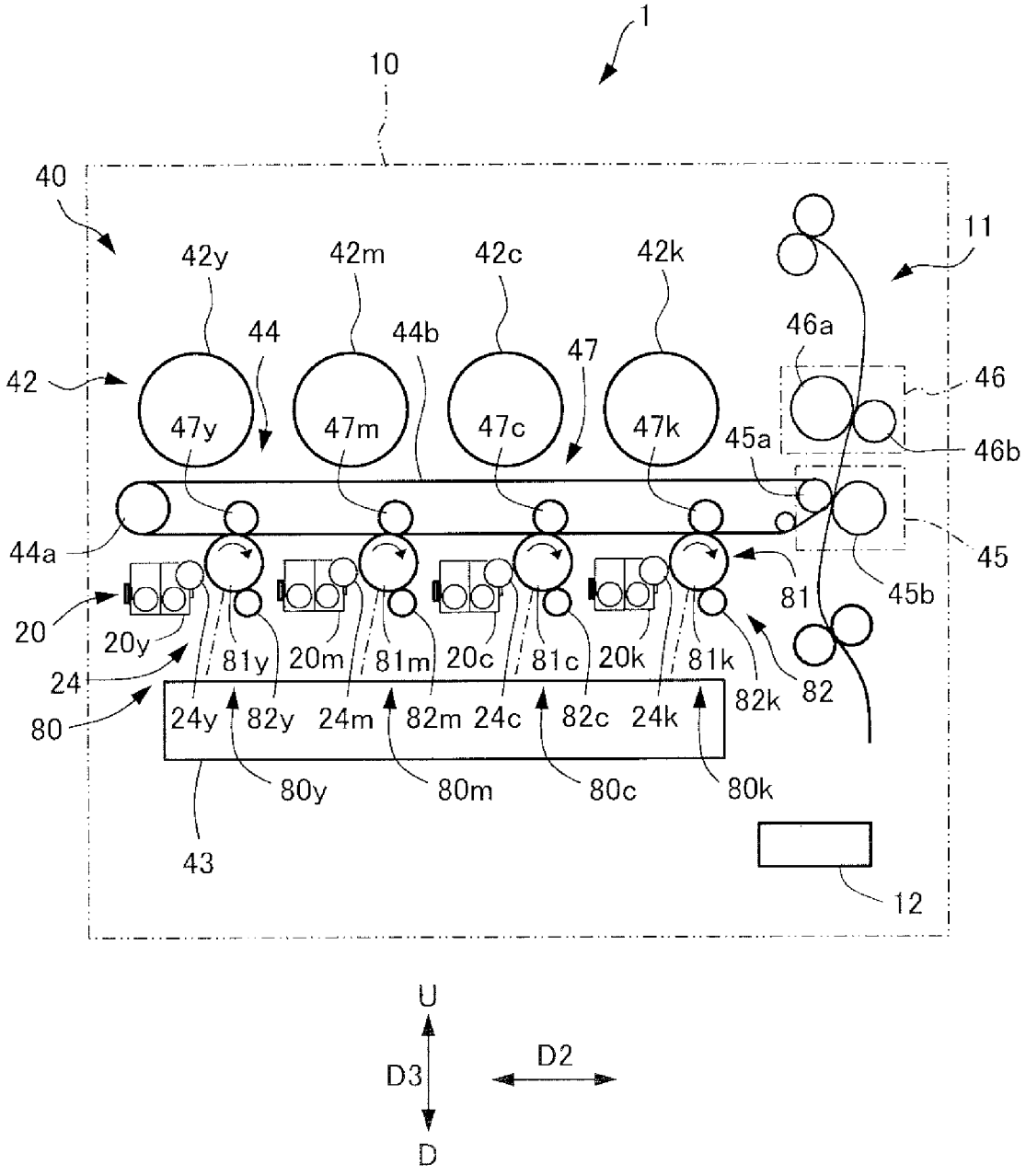
FIG. 1 is a section view illustrating a schematic configuration of an image forming apparatus of an embodiment.

As illustrated in FIG. 1, the image forming apparatus 1 includes an image forming apparatus body (referred to as an "apparatus body" hereinafter) 10 serving as a casing. The apparatus body 10 includes an image reading unit and a sheet feeding unit not illustrated, an image forming unit 40, a sheet conveyance unit 11, a sheet discharge portion not illustrated and a control unit 12. The image forming apparatus 1 is capable of forming a four-color full-color image on a recording material corresponding to an image signal from the image reading unit, a host device such as a personal computer or an external device such as a digital camera and a smartphone. Note that the sheet S serving as the recording material is a material on which the toner image is formed and is specifically a plain sheet of paper, a resin-made sheet serving as a substitute of the plain sheet of paper, a thick sheet or an overhead projector sheet.

The image forming unit 40 includes a drum cartridge (cartridge) 80, a developing unit 20, a toner container 42, a laser scanner 43, an intermediate transfer unit 44, a secondary transfer portion 45 and a fixing unit 46. The image forming unit 40 is capable of forming an image on the sheet S based on image information. It is noted that the image forming apparatus 1 of the present embodiment corresponds to full-color, and drum cartridges 80*y*, 80*m*, 80*c* and 80*k* are separately provided, with the similar configuration, for each of four colors of yellow (y), magenta (m), cyan (c) and black (k). Toner containers 42*y*, 42*m*, 42*c* and 42*k* are also separately provided, with the similar configuration, for each of the four colors of yellow (y), magenta (m), cyan (c) and black (k). Therefore, while each component in the four colors will be denoted with an identifier of each color after each reference sign in FIG. 1, there will be a case where each component is denoted only by a reference sign without appending such color identifier in FIG. 2 and in the specification. It is noted that in the present embodiment, a width direction orthogonal horizontally to a conveyance direction of the sheet S being convened, i.e., a depth direction of the image forming apparatus 1, will be denoted as a front-back direction D1, wherein a front side is denoted as F and a rear side is denoted as R. Still further, a lateral direction facing a front surface of the image forming apparatus 1 will be denoted as a lateral direction D2 and a vertical direction will be denoted as a vertical direction D3, wherein an upper side will be denoted as U and a lower side will be denoted as D.

The toner container 42 is a cylindrical bottle for example storing toner and is disposed above each the drum cartridge 80 in connection through a toner hopper. The laser scanner 43 exposes a surface of the photosensitive drum 81 charged by the charging roller 82 to form an electrostatic latent image on the surface of the photosensitive drum 81.

Figure 2:
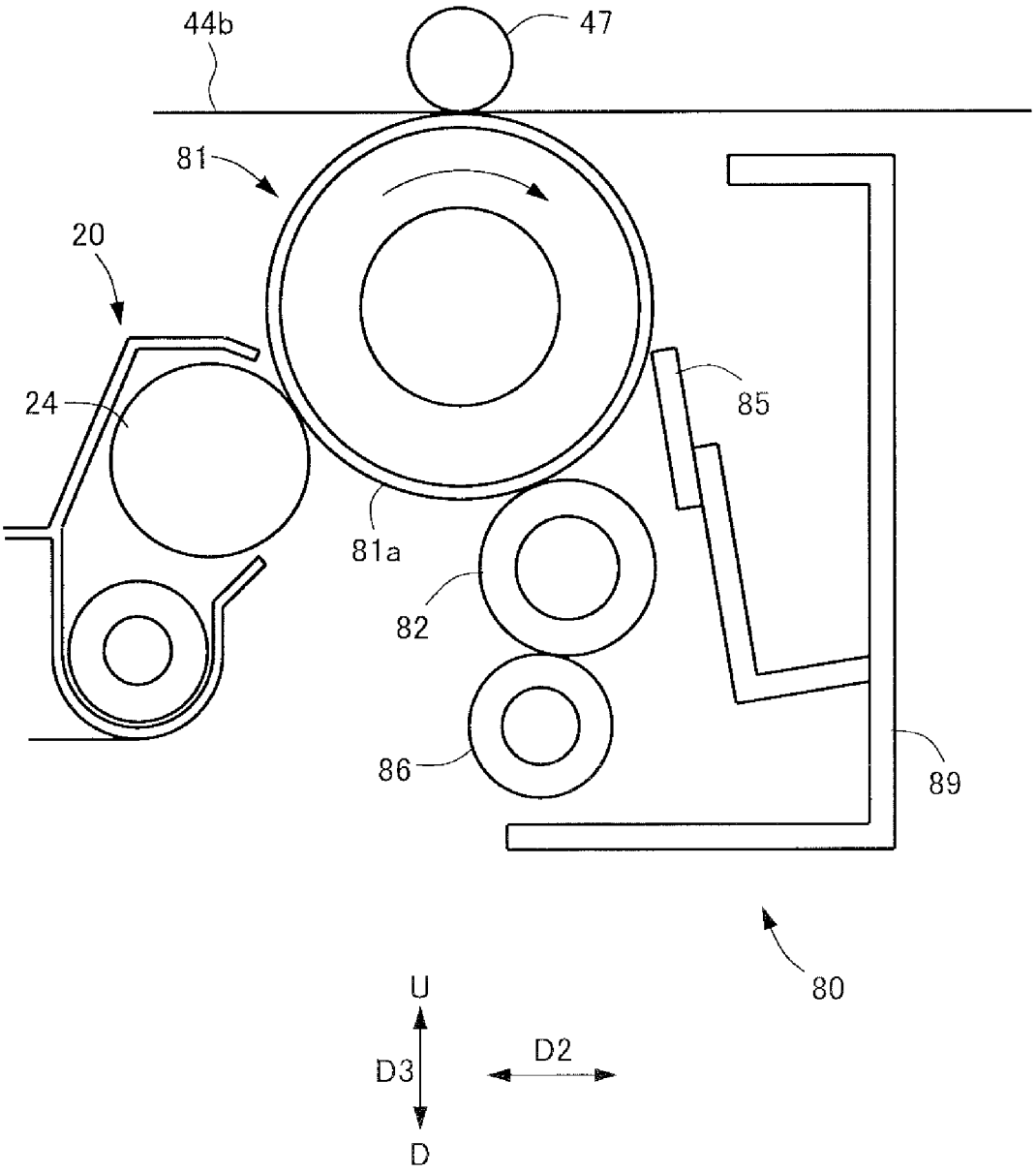
FIG. 2 is a section view illustrating a drum cartridge of the embodiment.

The drum cartridge 80 is an integrally unitized photosensitive member unit and is removably attached to the apparatus body 10. As illustrated in FIG. 2, the drum cartridge 80 includes the photosensitive drum 81 rotatable while bearing a toner image, a charging roller 82, a cleaning blade 85, a cleaning roller 86 in contact with the charging roller 82 and a casing 89. According to the present embodiment, the photosensitive drum 81, the charging roller 82, the cleaning roller 86 and the cleaning blade 85 are provided in the casing 89 and are integrated as the drum cartridge 80 (see FIG. 3). The casing 89 is made of resin and is attachable to/removable from the apparatus body 10. The drum cartridge 80 is separated from the developing unit 20 having a different durability life. The photosensitive drum 81, the charging roller 82, the developing unit 20 as well as a primary transfer roller 47 and a developing sleeve 24 described later are also separately provided, with the similar configuration, for four colors of yellow (y), magenta (m), cyan (c) and black (k).

The photosensitive drum 81 includes a photosensitive layer formed so as to have a negative charging polarity on an outer circumferential surface 81*a* of an aluminum cylinder and rotates with a predetermined process speed (circumferential speed). The charging roller 82 is in contact with the surface 81*a* of the photosensitive drum 81 to charge the surface 81*a* of the photosensitive drum 81 with a homogeneous negative dark part potential. After the charge, an electrostatic image is formed on the surface 81*a* of the photosensitive drum 81 by the laser scanner 43 based on the image information. The photosensitive drum 81 moves peripherally while bearing the formed electrostatic image which is to be developed by toner by the developing sleeve 24 of the developing unit 20. The developed toner image is primarily transferred onto the intermediate transfer belt 44*b* as described later. The surface of the photosensitive drum 81 after the primary transfer is destaticized by a pre-exposing portion not illustrated. The cleaning blade 85 is disposed in contact with the surface 81*a* of the photosensitive drum 81 to clean residual matters such as transfer residual toner left on the surface 81*a* of the photosensitive drum 81 after the primary transfer. The configuration of the drum cartridge 80 will be detailed later.

As illustrated in FIG. 1, the intermediate transfer unit 44 is disposed above the drum cartridges 80*y*, 80*m*, 80*c* and 80*k*. The intermediate transfer unit 44 includes a plurality of rollers such as a driving roller 44*a*, a driven roller and primary transfer rollers 47*y*, 47*m*, 47*c* and 47*k*, and the intermediate transfer belt 44*b* wound around these rollers. The primary transfer rollers 47*y*, 47*m*, 47*c* and 47*k* are disposed so as to face the photosensitive drums 81*y*, 81*m*, 81*c* and 81*k* and to be in contact with the intermediate transfer belt 44*b* to primarily transfer the toner images formed on the photosensitive drums 81 to the intermediate transfer belt 44*b*.

The toner image formed on the photosensitive drum 81 is primarily transferred onto the intermediate transfer belt 44*b* by a primary transfer bias applied at the primary transfer portion. The transfer portion 45 includes a secondary transfer inner roller 45*a* and a secondary transfer outer roller 45*b*, and the toner image on the intermediate transfer belt 44*b* is secondarily transferred onto the sheet S by applying a secondary transfer bias at a nip portion between the secondary transfer outer roller 45*b* and the intermediate transfer belt 44*b*. The fixing unit 46 includes a fixing roller 46*a* and a pressure roller 46*b*, and the toner image transferred onto the sheet S is heated and pressurized to be fixed to the sheet S as the sheet S is conveyed while being nipped by the fixing roller 46*a* and the pressure roller 46*b*.

The control unit 12 is consisted of a computer and includes a CPU, a ROM storing programs controlling each unit, a RAM temporarily storing data and an input/output circuit inputting/outputting a signal from/to an external device. The CPU is a microprocessor controlling an entire control of the image forming apparatus 1 and is a main body of a system controller. The CPU is connected with the image reading unit, the sheet feeding unit, the image forming unit 40, the sheet conveyance unit 11 and an operation part through the input/output circuit to exchange signals with each portions and control operations.

Next, an image forming operation of the image forming apparatus 1 constructed as described above will be described.

As the image forming operation starts, the photosensitive drum 81 rotates and the surface thereof is charged by the charging roller 82. Then, based on the image information, the photosensitive drum 81 is irradiated by the laser scanner 43 with a laser beam to form an electrostatic latent image on the surface of the photosensitive drum 81. Toner is applied to the electrostatic latent image by the developing unit 20 to visualize as a toner image that is to be transferred onto the intermediate transfer belt 44*b*.

Meanwhile, in parallel with such toner image forming operation, the sheet feeding unit operates and conveys the sheet S to the secondary transfer portion 45 in synchronism with the toner image on the intermediate transfer belt 44*b*. Then the image is transferred from the intermediate transfer belt 44*b* to the sheet S. The sheet S is conveyed to the fixing unit 46 such that the non-fixed toner image is heated and pressurized to fix on the surface of the sheet S. The sheet S is then discharged out of the apparatus body 10.

Next, a configuration for attaching/detaching the drum cartridge 80 to/from the apparatus body 10 will be detailed based on FIGS. 3 through 6. The photosensitive drum 81, the charging roller 82 and the cleaning blade 85 (see FIG. 2) included in the drum cartridge 80 deteriorate as image forming processes are conducted and their service lives come to end earlier than the apparatus body 10, it is necessary to replace the drum cartridge 80 corresponding to a print quantity. Still further, readiness of the replacement is required to shorten an operation time of a serviceman and to enable a user to replace the drum cartridge 80. Accordingly, the drum cartridge 80 is configured to be able to replace readily from the front side of the apparatus body 10 by enabling to attach/detach in the front-back direction D1 of the apparatus body 10. This configuration will be described in detail below.

Figure 3:
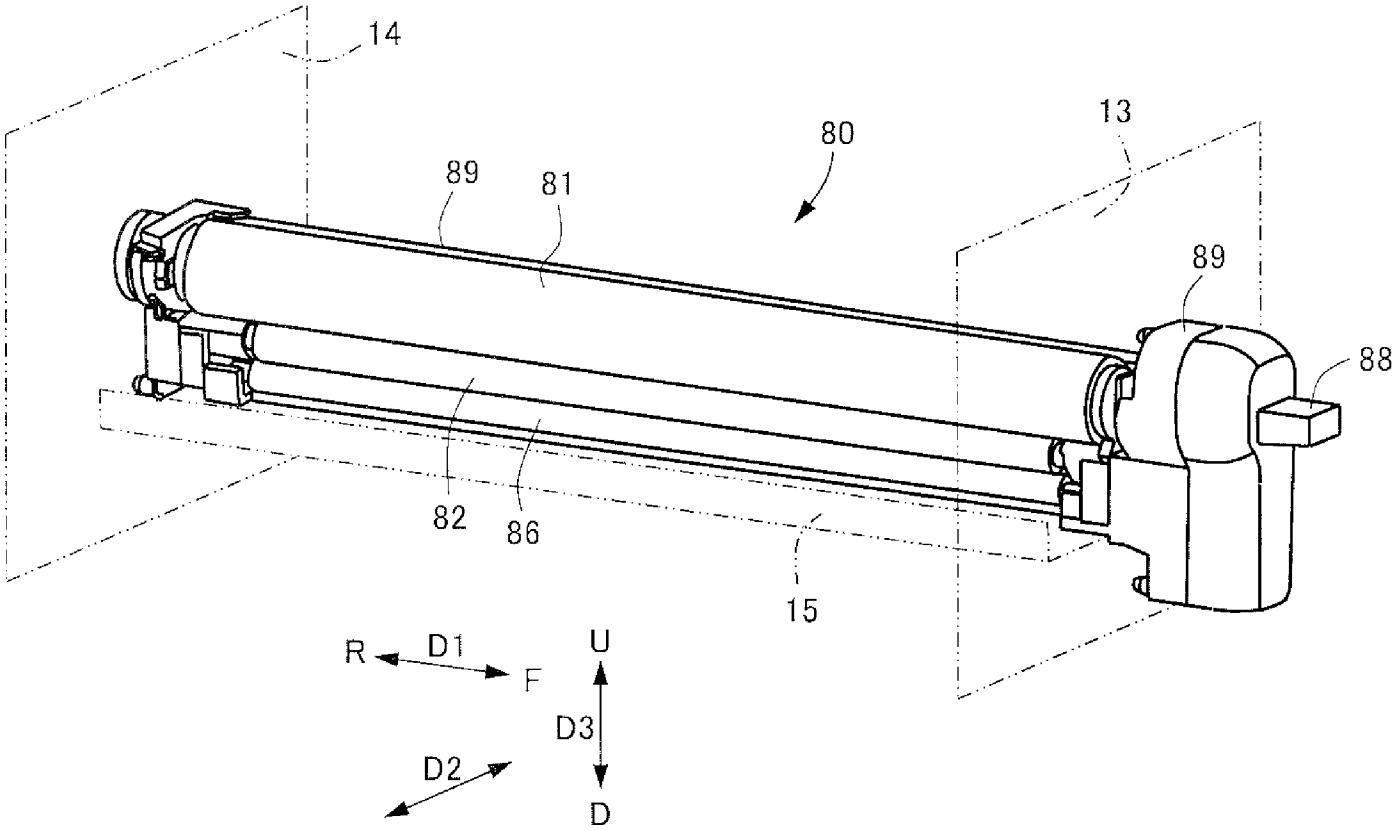
FIG. 3 is a perspective view illustrating the drum cartridge of the embodiment.

As illustrated in FIG. 3, the apparatus body 10 (see FIG. 1) includes a front frame plate 13 provided so as to erect on the front side F and a rear frame plate 14 provided so as to erect on the rear side R. Still further, a guide rail 15 lengthy in the front-back direction D1 is fixed, by means of screw or the like, to the front frame plate 13 and the rear frame plate 14. The guide rail 15 supports the drum cartridge 80 from downward and guides the drum cartridge 80 in the front-back direction D1 in attaching/detaching each drum cartridge 80.

Figure 4:
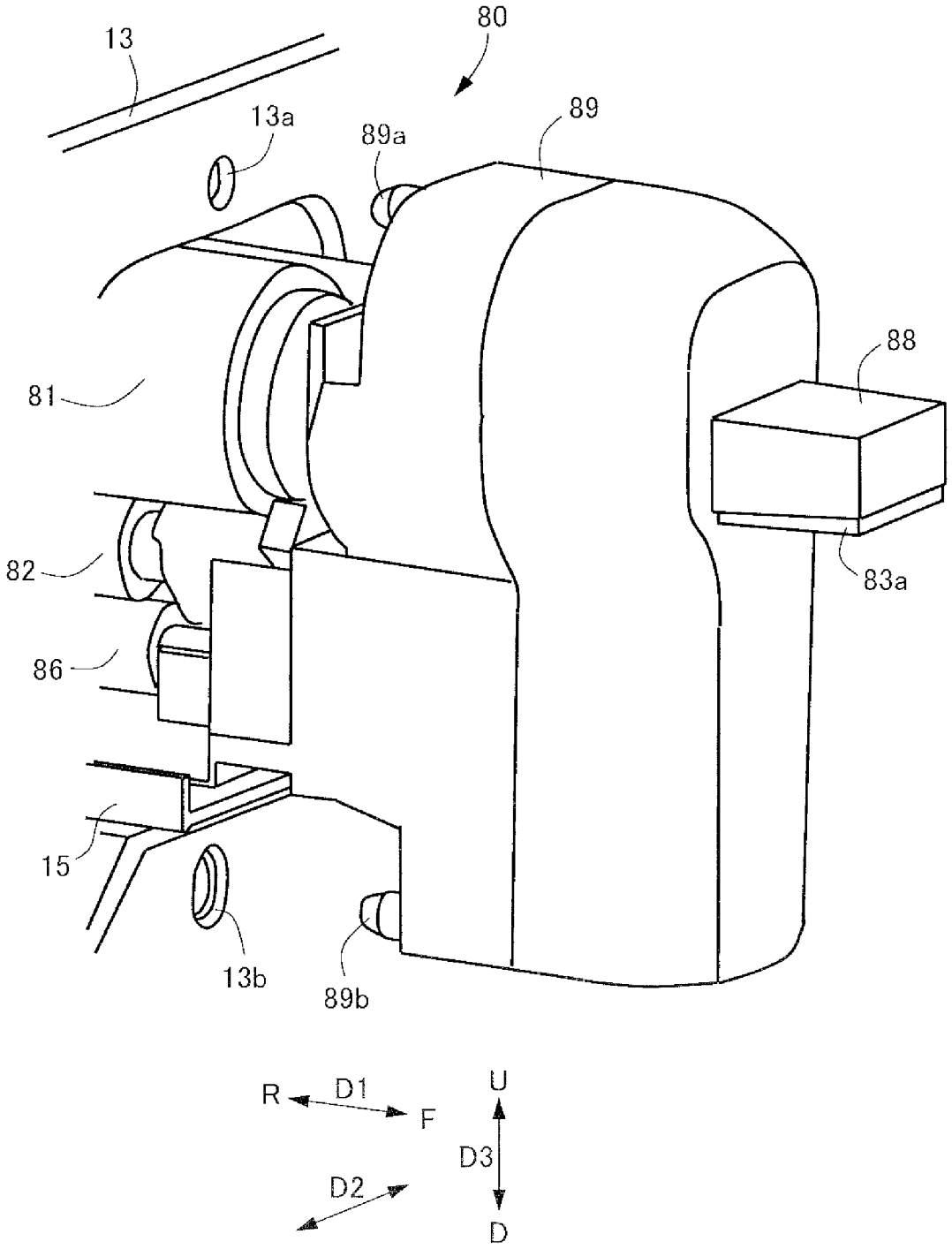
FIG. 4 is a perspective view illustrating a front side of the drum cartridge of the embodiment.

As illustrated in FIG. 4, a positioning portion 89*a* and a rotation stopping portion 89*b* projecting toward the rear side R are formed on the front side F of the casing 89. A positioning hole 13*a* and a rotation stopping hole 13*b* are defined through the front frame plate 13 so as to face the positioning portion 89*a* and the rotation stopping portion 89*b*. In attaching the drum cartridge 80 to the apparatus body 10, the positioning portion 89*a* and the rotation stopping portion 89*b* are fitted respectively into the positioning hole 13*a* and the rotation stopping hole 13*b*. Thereby, positioning of the drum cartridge 80 to the apparatus body 10 in terms of the lateral direction D2 and the vertical direction D3 are made on the front side F of the drum cartridge 80. A grip 88 projecting toward the front side F such that the user can grasp in attaching/detaching the drum cartridge 80 to the apparatus body 10 is also formed on the front side F of the casing 89.

Figure 5:
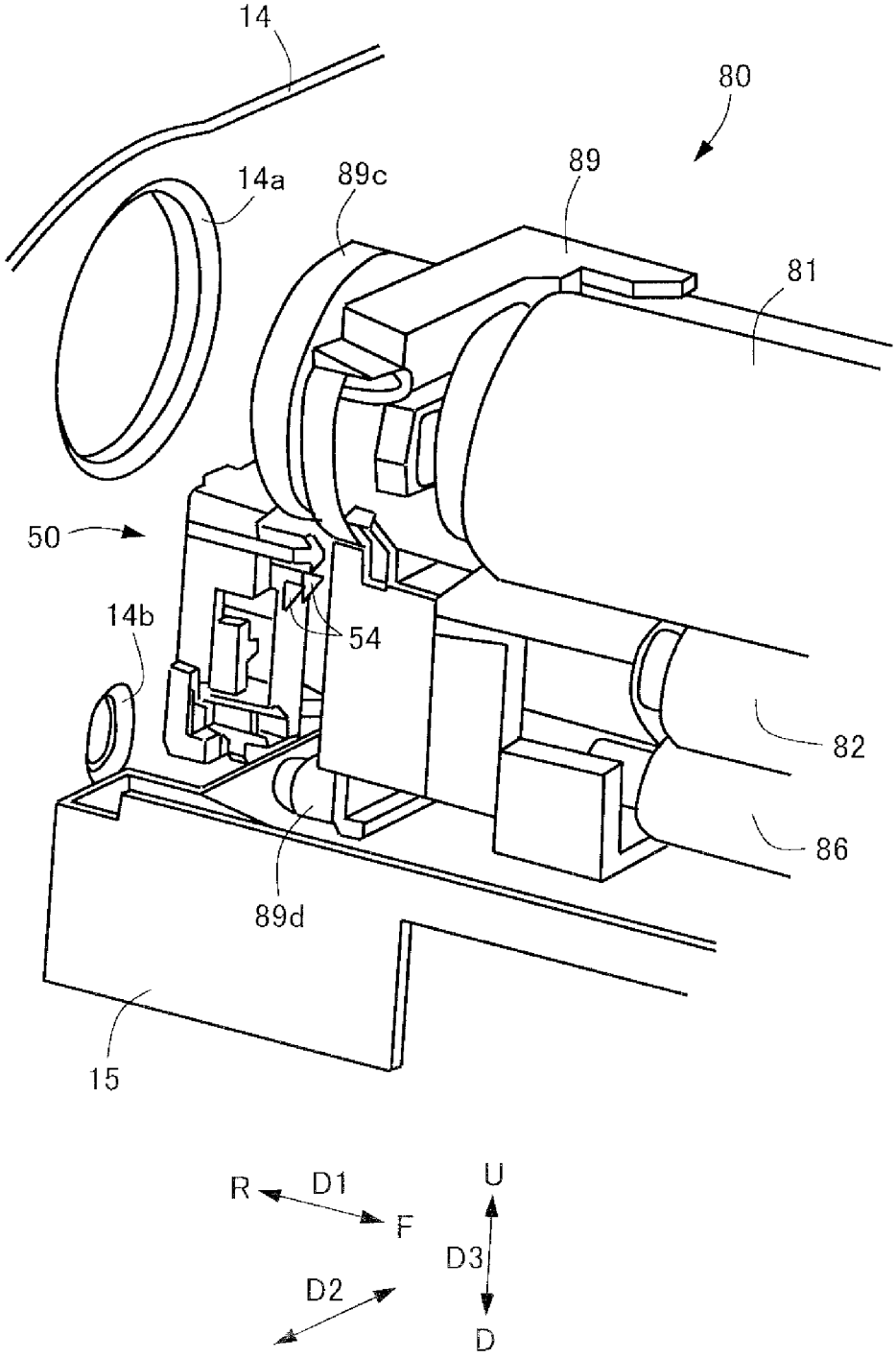
FIG. 5 is a perspective view illustrating a rear side of the drum cartridge of the embodiment.

As illustrated in FIG. 5, a positioning portion 89*c* and a rotation stopping portion 89*d* projecting toward the rear side R are provided on the rear side R of the casing 89. The positioning portion 89*c* is provided by screwing an approximately cylindrical member, which is a separate member from the casing 89, to the casing 89. A positioning hole 14*a* and a rotation stopping hole 14*b* are defined through the rear frame plate 14 so as to face the positioning portion 89*c* and the rotation stopping portion 89*d*. In attaching the drum cartridge 80 to the apparatus body 10, the positioning portion 89*c* and the rotation stopping portion 89*d* are fitted respectively into the positioning hole 14*a* and the rotation stopping hole 14*b*. Thereby, positioning of the drum cartridge 80 to the apparatus body 10 in terms of the lateral direction D2 and the vertical direction D3 are made on the rear side R of the drum cartridge 80.

Figure 6:
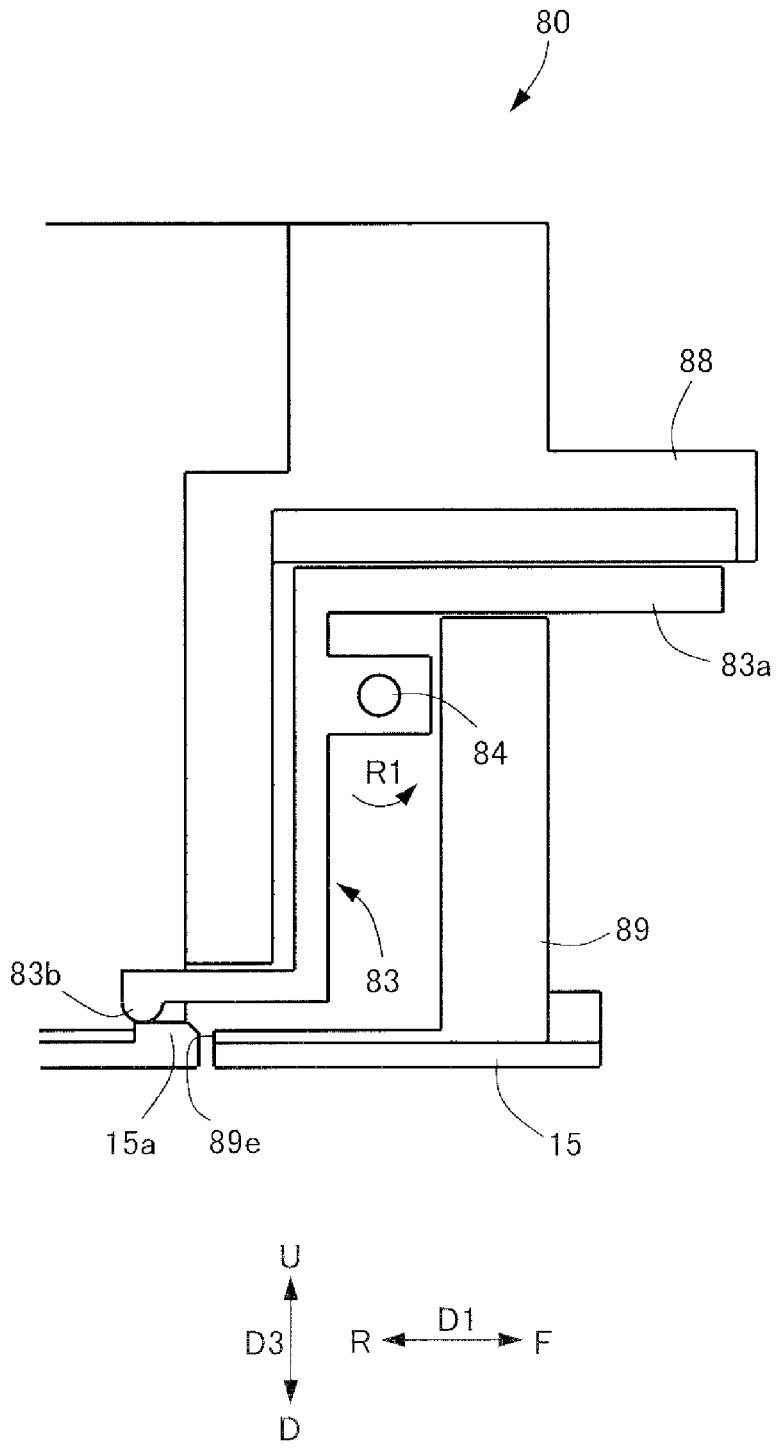
FIG. 6 is a section view illustrating a lock mechanism of the drum cartridge and a rail of the embodiment.

As illustrated in FIG. 6, the guide rail 15 is formed approximately into a channel from which an upper side U is opened, and a lock portion 15*a* projecting toward the upper side U and elastically deformably supported in the vertical direction D3 is formed on the front side F of the guide rail 15. The drum cartridge 80 includes a lock hole 89*e* defined at a lower surface of the front side F of the casing 89 and a lock releasing member 83 provided at the front side F of the casing 89. The drum cartridge 80 is locked to the guide rail 15 in the front-back direction D1 by engaging the lock portion 15*a* with the lock hole 89*e*. The lock releasing member 83 is formed approximately into a shape of a character Z, and an approximate center part thereof is pivotally supported by a pivot shaft 84 provided in the casing 89. A first end portion of the lock releasing member 83 projects toward the front side F right under the grip 88 provided at a front end portion of the casing 89 to be an operating portion 83*a* operable by the user by pressing toward the upper side U by grasping together with the grip 88. Along with the operation of the operating portion 83*a*, a second end of the lock releasing member 83 is made to be a press-down portion 83*b* that can press down the lock portion 15*a* engaging with the lock hole 89*e* from the upper side U.

Next, a procedure in attaching/detaching the drum cartridge 80 to/from the apparatus body 10 will be described. When the service life of the drum cartridge 80 comes to end, the drum cartridge 80 whose service life has ended is taken out of the apparatus body 10 to replace with a new drum cartridge 80. At this time, the drum cartridge 80 is enabled to be attached/detached in the front-back direction D1 of the apparatus body 10 from an aspect of improvement of operability, so that the drum cartridge 80 can be readily replaced.

Firstly, in attaching the drum cartridge 80, the user mounts the drum cartridge 80 on the guide rail 15 and pushes into the rear side R while grasping the grip 88 and others of the drum cartridge 80. A bottom surface of the drum cartridge 80 is supported by the upper surface of the guide rail 15. Because the guide rail 15 is formed approximately into a channel shape whose upper side U is opened and is provided so as to have a fine clearance with respect to the drum cartridge 80 and to sandwich the drum cartridge 80 from the lateral direction D2, the drum cartridge 80 is smoothly guided while been regulated in the lateral direction D2 in inserting into the drum cartridge 80. While inserting the drum cartridge 80 into the apparatus body 10, the lock portion 15*a* of the guide rail 15 engages with the lock hole 89*e* provided at the bottom of the casing 89 as illustrated in FIG. 6. Thereby, the drum cartridge 80 is locked so as not to be drawn out of the apparatus body 10 to the front side F. Still further, the drum cartridge 80 receives a pressurizing force to the front side F from the apparatus body 10 by a pressing member not illustrated. Therefore, positioning of the drum cartridge 80 in the front-back direction D1 is made as an edge portion on the rear side R of the lock hole 89*e* of the drum cartridge 80 abuts with the lock portion 15*a* from the rear side R, thus completing the attachment.

Still further, in detaching the drum cartridge 80, the user grasps the grip 88 of the drum cartridge 80 and, in the same time, pinches the operating portion 83*a* to push up to the upper side U. Thereby, the lock releasing member 83 pivots in a rotation direction R1 centering on the pivot shaft 84 and the press-down portion 83*b* pivots and elastically presses down the lock portion 15*a* in the same time. Thus, the lock of the drum cartridge 80 with the apparatus body 10 is released. Then, after releasing the lock of the drum cartridge 80, the user can draw the drum cartridge 80 out of the apparatus body 10 to the front side F while pinching the grip 88. It is noted that because the drum cartridge 80 is guided by the guide rail 15 also in detaching the drum cartridge 80, the drum cartridge 80 can be drawn out smoothly while being regulated in the lateral direction D2.

Figure 7:
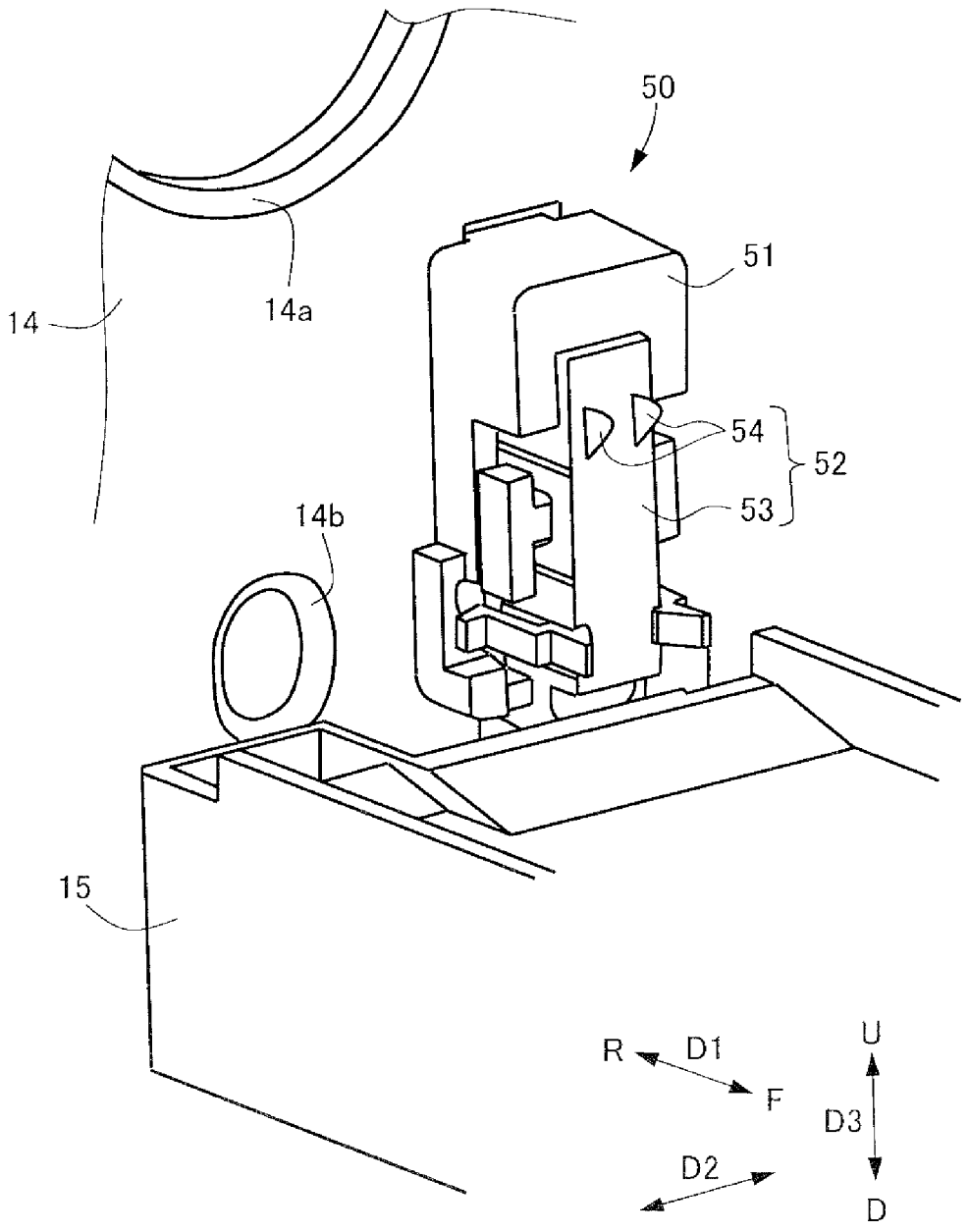
FIG. 7 is a perspective view illustrating a contact unit of an apparatus body of the embodiment.
Figure 8:
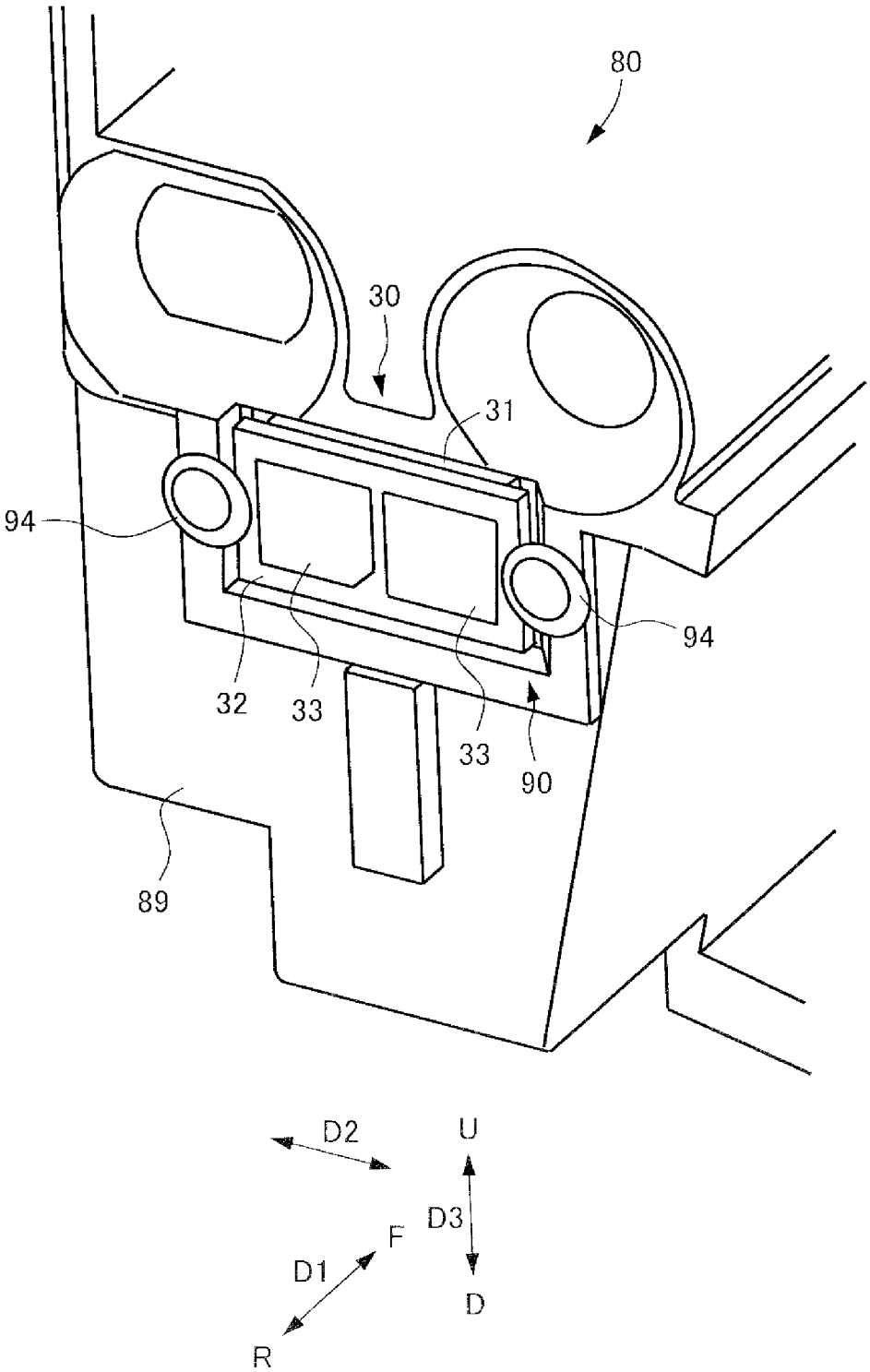
FIG. 8 is a perspective illustrating a memory portion of the drum cartridge of the embodiment.
Figure 9:
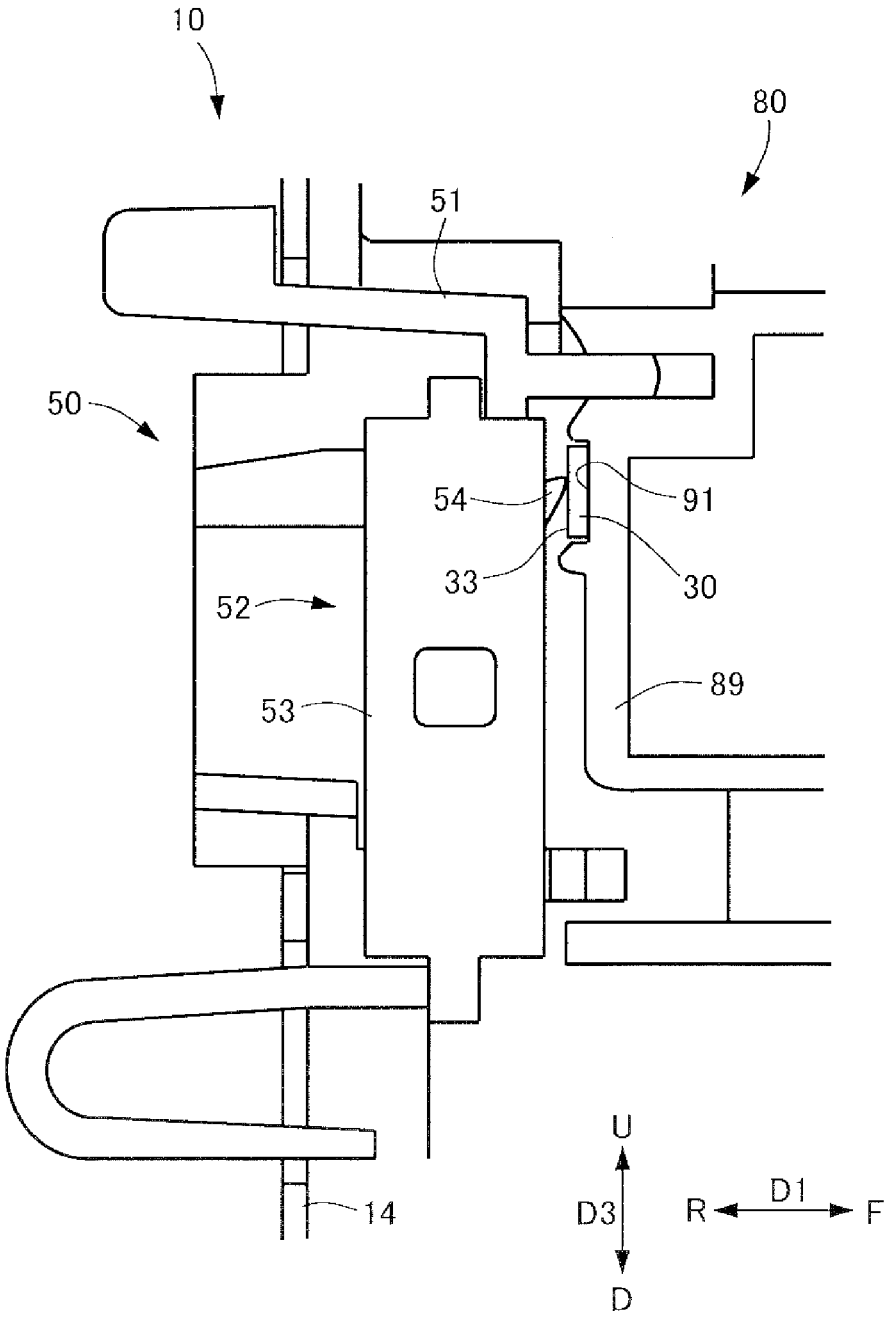
FIG. 9 is a longitudinal section view illustrating a condition in which the contact unit of the apparatus body is connected with the memory portion of the cartridge of the embodiment.

Next, a configuration of a contact part of a memory portion (memory chip) 30 of the drum cartridge 80 with a contact unit 50 of the apparatus body 10 will be detailed based on FIGS. 7 through 9. As illustrated in FIG. 7, the contact unit 50 is attached to the rear frame plate 14 of the apparatus body 10. The contact unit 50 includes a holder 51 and a connector 52. The holder 51 is fixed to the rear frame plate 14 by snap-fit or screwing not illustrated. The connector 52 is fixed to the holder 51 by snap-fit or screwing not illustrated.

The connector 52 includes a connector body 53, a body-side contact portion 54 and a bundle wire not illustrated. The body-side contact portion 54 is made of a low resistant member and is formed by plating nickel and gold on a base material of copper alloy for example. The body-side contact portion 54 is provided so as to project to the front side F from a surface on the front side F of the connector body 53 and is elastically deformable in the front-back direction D1. The bundle wire is electrically connected with the body-side contact portion 54 within the connector body 53 and is connected with the control unit 12 of the apparatus body 10.

As illustrated in FIG. 8, the memory portion 30 is provided at an end portion on the rear side R of the drum cartridge 80. That is, the memory portion 30 is attached to a downstream side surface in an insertion direction (the rear side R direction) in which the drum cartridge 80 is inserted into the image forming apparatus 1. The memory portion 30 includes a memory element 31, a substrate 32 and a memory-side contact portion 33 provided on the substrate 32 and serves as a planar, i.e., a flat plate, information storage unit storing information to be outputted to the image forming apparatus 1. Information such as date of manufacture and a lot number of the drum cartridge 80 is stored in the memory element 31. The memory portion 30 is provided at a position where the memory-side contact portion 33 comes into contact with the body-side contact portion 54 of the apparatus body 10 when the drum cartridge 80 is attached to the apparatus body 10. That is, the memory portion 30 is provided such that at least a part of the memory-side contact portion 33 is exposed to outside of the casing 89. The memory portion 30 is attached to the casing 89 by thermal caulking in the present embodiment in a condition of having minute gaps and of being regulated from moving in the respective directions D1, D2 and D3.

As illustrated in FIG. 9, by attaching the drum cartridge 80 to the apparatus body 10, the body-side contact portion 54 comes into contact with the memory-side contact portion 33 in the front-back direction D1 as a contact direction. At this time, because the body-side contact portion 54 is elastically deformable in the front-back direction D1, the memory-side contact portion 33 is in contact with the body-side contact portion 54 while receiving a reaction force to the front side F from the body-side contact portion 54. That is, the memory-side contact portion 33 comes into contact with the body-side contact portion 54 provided in the apparatus body 10 when the casing 89 is attached to the apparatus body 10. When the drum cartridge 80 is attached to the apparatus body 10 and is positioned, the memory-side contact portion 33 is connected electrically stably with the body-side contact portion 54 as the contact of the memory-side contact portion 33 is made while receiving the predetermined reaction force from the body-side contact portion 54. As the drum cartridge 80 is positioned to the apparatus body 10 and the body-side contact portion 54 comes into contact with the memory-side contact portion 33, it becomes possible to exchange cartridge information and apparatus body information between the control unit 12 and the memory portion 30.

Figure 10:
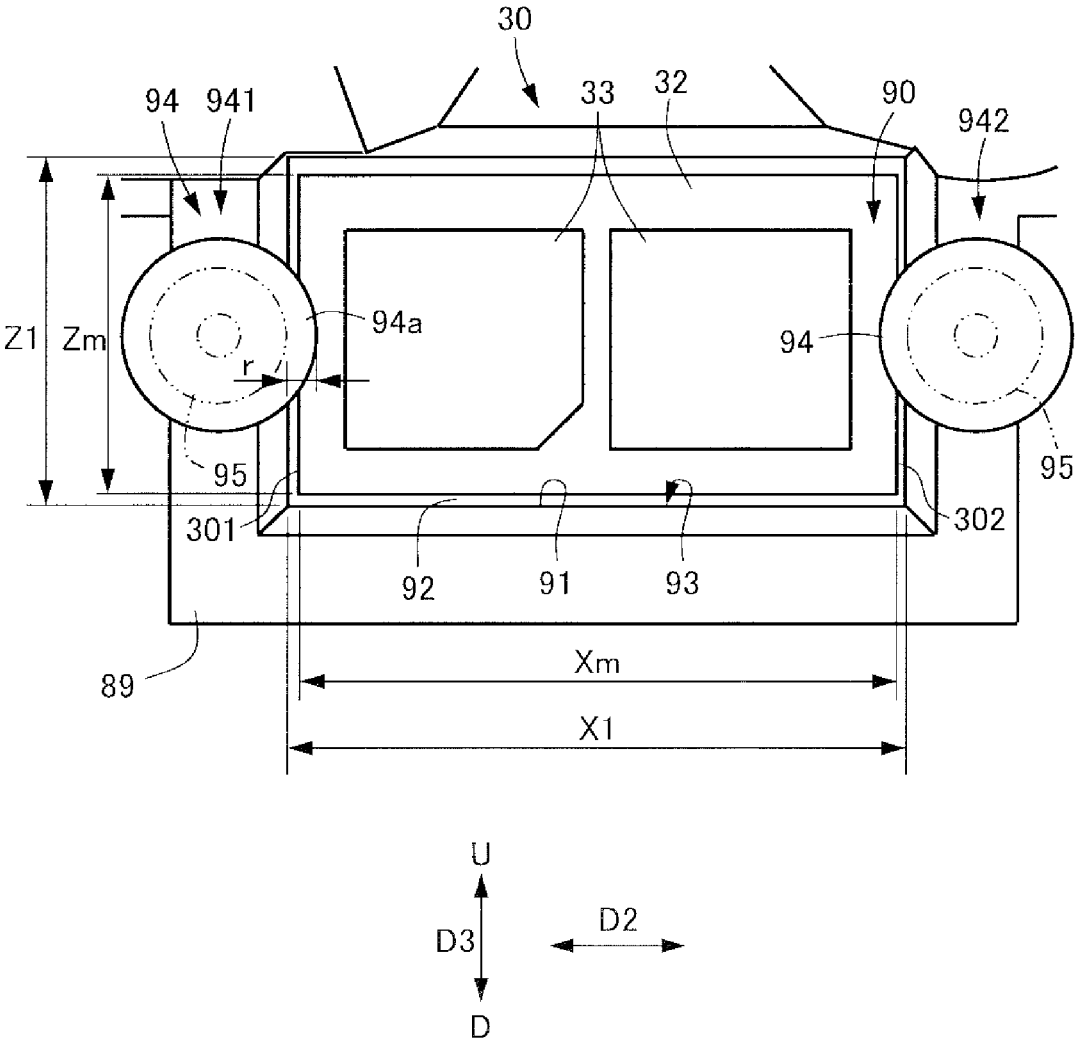
FIG. 10 is a back view illustrating the memory portion of the cartridge of the embodiment.
Figure 11:
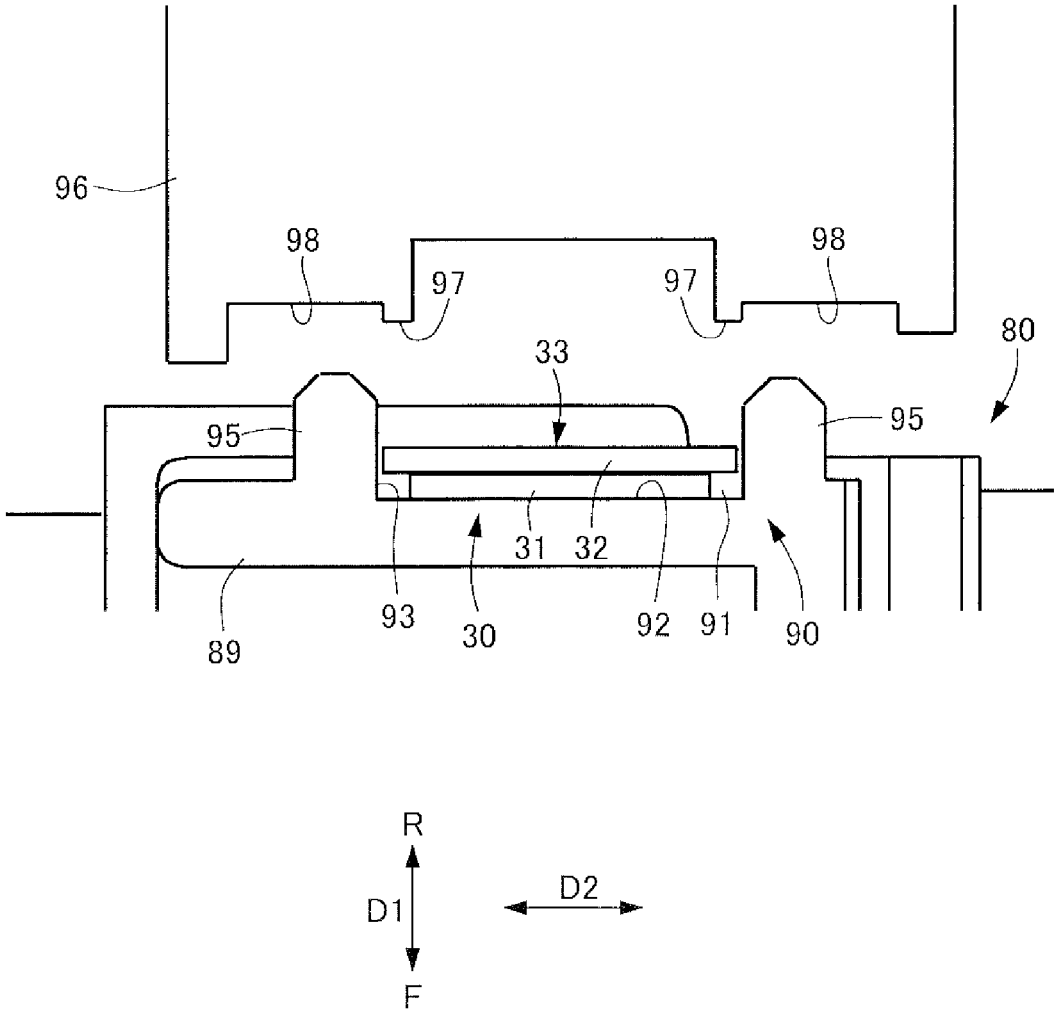
FIG. 11 is a horizontal section view illustrating a condition before forming a thermal caulking portion of a supporting portion of the memory portion of the drum cartridge of the embodiment.

Next, a configuration of a supporting portion 90 of the memory portion 30 of the drum cartridge 80 will be described in detail based on FIGS. 10 through 12. The drum cartridge 80 includes the supporting portion 90 retaining the memory portion 30 in the casing 89. The supporting portion 90 includes a recess portion (retaining portion) 91 recessed in the front side F at the end portion on the rear side R of the casing 89 and thermal caulking portions (regulating portion, projecting portions) 94 provided at both end portions in the lateral direction D2 of the recess portion 91 at the end portion on the rear side R of the casing 89, and is integrated with the casing 89. The supporting portion 90 disables the memory portion 30 from being detached from the casing 89. The recess portion 91 is formed into an approximately rectangular shape when viewed from the rear side R and at least a part of the memory portion 30 is embedded therein in the front-back direction D1. The recess portion 91 includes a bottom portion (recess surface) 92 facing the rear side R and a side wall portion (side wall) 93 facing in the lateral direction D2 and the vertical direction D3.

The recess portion 91 is provided on an outer surface of the casing 89 to fit the memory portion 30. The memory portion 30 is attached with a posture substantially surrounded by the side wall portion 93 of the recess portion 91 and in a condition in which the memory portion 30 is displaceable within the recess portion 91. The recess portion 91 is provided on the side surface of the casing 89 and the bottom portion 92 of the recess portion 91 is formed along the side surface of the casing 89. The memory portion 30 is attached such that the bottom portion 92 of the recess portion 91 faces the surface of the memory portion 30. Thereby, the recess portion 91 retains the memory portion 30 by regulating the memory portion 30 from moving in a direction of the surface of the memory portion 30.

Figure 12:
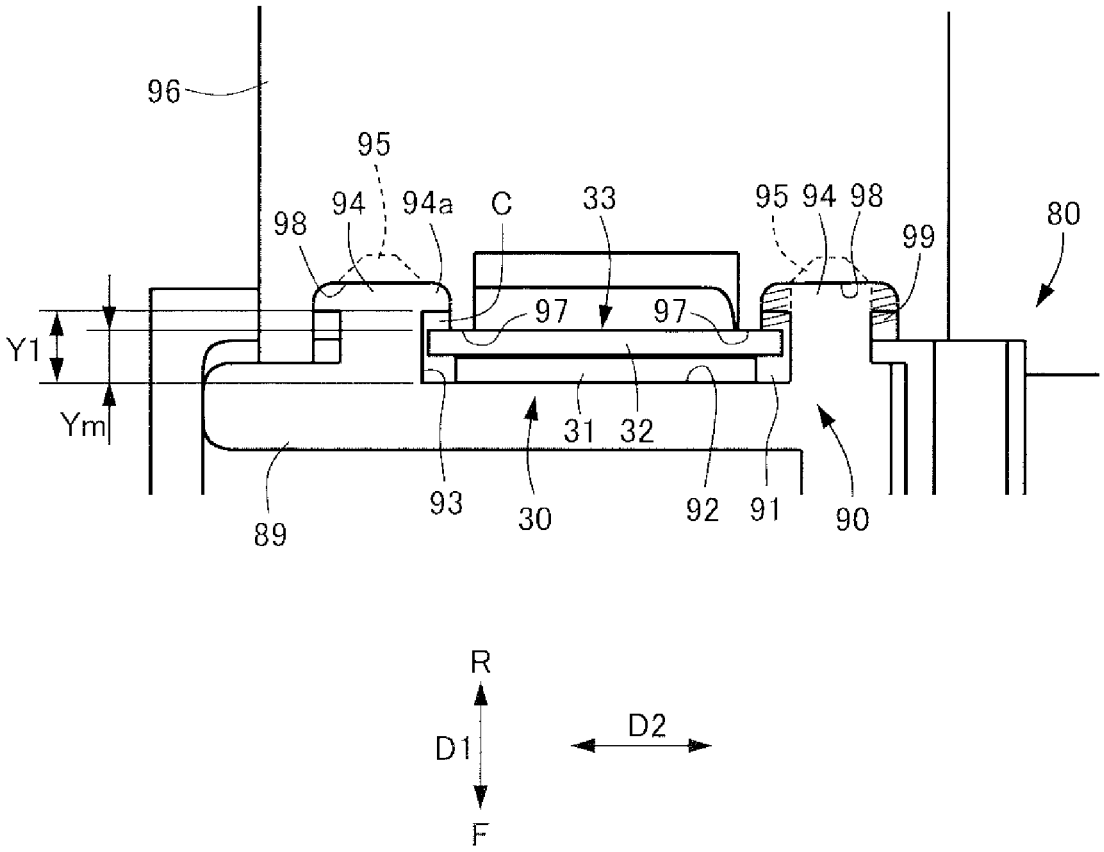
FIG. 12 is a horizontal section view illustrating a condition on a way of forming the thermal caulking portion of the supporting portion of the memory portion of the drum cartridge of the embodiment.

The thermal caulking portions 94 are provided on a side opposite from the bottom portion 92 across the memory portion 30 in terms of the front-back direction D1 and regulate the memory portion 30 from moving in a direction separating away from the recess portion 91 by being in contact with the memory portion 30 (see FIG. 12). The thermal caulking portion 94 is formed integrally with the casing 89, is provided so as to project from the outer surface of the casing 89 in a direction of intersecting with the surface of the memory portion 30 and regulates the memory portion 30 from moving in the direction intersecting with the surface of the memory portion 30. It is noted that the thermal caulking portion 94 is formed by thermally caulking a protrusion (project portion) 95 provided on the casing 89 so as to project from the outer surface of the casing 89 (see FIG. 11). The protrusion 95 is formed approximately to be rod shape so as to project out of the outer surface of the casing 89 in a direction orthogonal to the bottom portion 92. The thermal caulking portion 94 is formed after the memory portion 30 is attached to the recess portion 91 through a process of thermal deformation.

The bottom portion 92 and the thermal caulking portion 94 of the recess portion 91 serving as a first regulating portion regulate the move of the memory portion 30 with respect to the casing 89 within a first range in terms of the front-back direction D1 and retains the memory portion 30 movably within the first range (see FIG. 12). The side wall portion 93 of the recess portion 91 serving as a second regulating portion regulates the move of the memory portion 30 with respect to the casing 89 within a second range in terms of the lateral direction D2 and the vertical direction D3 and retains the memory portion 30 movably within the second range (see FIG. 10).

According to the present embodiment, the memory portion 30 has an approximately rectangular parallelepiped shape of a length in the lateral direction D2: Xm=6.5 mm, of a width in the vertical direction D3: Zm=3.5 mm and of a thickness in the front-back direction D1: Ym=1 mm for example. As illustrated in FIG. 10, a length X1 in the lateral direction D2 and a width Z1 in the vertical direction D3 of the recess portion 91 of the casing 89 are set be respectively larger than the length Xm and the width Zm of the memory portion 30 to create a gap necessarily between the memory portion 30. Here, sizes of the recess portion 91 of the casing 89 are set to be the length X1=7 mm and the width Z1=4 mm for example. That is, the second range in which the side wall portion 93 of the recess portion 91 regulates the move of the memory portion 30 with respect to the casing 89 is the length X1=7 mm in the lateral direction D2 and the width Z1=4 mm in the vertical direction D3 in the present embodiment. It is noted that the second range is increased more than a degree by which the drum cartridge 80 attached to the apparatus body 10 is movable with respect to the apparatus body 10 in the lateral direction D2 and the vertical direction D3.

Still further, as illustrated in FIG. 12, a depth Y1 in the front-back direction D1 between the bottom portion 92 of the recess portion 91 and the thermal caulking portion 94 of the casing 89 is set to be greater than a thickness Ym of the memory portion 30 to necessarily create a gap between the memory portion 30. Here, the depth is set to be Y1=1.5 mm for example. That is, according to the present embodiment, the first range in which the bottom portion 92 of the recess portion 91 and the thermal caulking portion 94 regulate the move of the memory portion 30 with respect to the casing 89 is the depth Y1=1.5 mm in the front-back direction D1.

According to the present embodiment, the thermal caulking portions 94 are provided at positions abuttable with two short sides of the rectangular memory portion 30 in view from the rear side R. The thermal caulking portions 94 are provided so as to face short sides 301 and 302 of the memory portion 30. According to the present embodiment, a plurality of thermal caulking portions 94 is provided as a first thermal caulking portion (first regulating portion, first project portion) 941 and a second thermal caulking portion (second regulating portion, second project portion) 942. The first thermal caulking portion 941 is provided so as to face a first short side 301 of the memory portion 30 and the second thermal caulking portion 942 is provided so as to face a second short side 302 of the memory portion 30. These first and second thermal caulking portions 941 and 942 are disposed so as to face with each other in a longitudinal direction of the memory portion 30. That is, the thermal caulking portions 94 are provided at both right and left end portions of the memory portion 30 provided longitudinally in the lateral direction D2. This arrangement makes it possible to suppress the memory portion 30 from being fallen down when the memory portion 30 moves within the recess portion 91 and to reduce an area overlapping with the memory-side contact portion 33 as compared to a case where the thermal caulking portions 94 are provided on the long sides part.

Here, a procedure for forming the thermal caulking portions 94 on the both end portions in the lateral direction D2 of the memory portion 30 will be described. At first, as illustrated in FIG. 11, protrusions 95 protruding to the rear side R are provided adjacent both sides in the lateral direction D2 of the recess portion 91 before the thermal caulking portions 94 are formed. The protrusions 95 are formed approximately into a cylindrical shape of 1.5 mm of diameter and 2.6 mm of height from rear end faces of the casing 89. Then, the memory portion 30 is attached to the recess portion 91 of the casing 89. At this time, the memory portion 30 has a minute clearance to the side wall portion 93 of the recess portion 91 in terms of the lateral direction D2 and the vertical direction D3 (see FIG. 10) and is regulated to be movable within the second range by the side wall portion 93 of the recess portion 91. Still further, in this condition, the memory portion 30 is freely movable in a condition in which there is no regulation in terms of the front-back direction D1. However, in conducting the thermal caulking as described later, the memory portion 30 comes into contact with, and is retained by, the bottom portion 92 of the recess portion 91 by receiving a gravitational force G.

Thermal caulking is conducted on the protrusions 95 provided on the casing 89 by a die (caulking horn) 96. The die 96 is connected with a heat supplying portion not illustrated and is heated up to around 200° C. by heat supplied from the heat supplying portion. The die 96 is desirable to be made of brass or others having high heat conductivity from an aspect of reducing a manufacturing cycle time. Butting portions 97 butting against the memory portion 30 and fusing portions 98 coming into contact and fusing the protrusions 95 are provided on an end portion of the die 96. The protrusions 95 melt as the fusing portions 98 come into contact with tip portions of the protrusions 95 in a condition in which the die 96 is heated.

Next, sizes of the protrusions 95 and the die 96 will be described. When the butting portion 97 of the die 96 butts against the memory portion 30, a material of a volume V1 of a part (broken line parts in FIG. 12) where the fusing portion 98 overlaps with the protrusion 95 melts. The molten protrusion 95 is filled in a space 99 (hatched part in FIG. 12) provided in a gap surrounded by the casing 89, the die 96 and the memory portion 30. The minute gap C is provided between the memory portion 30 and the protrusion 95 by setting the volume V1 of the molten protrusion 95 and a volume V2 of the space 99 such that a relationship between V1 and V2 meets a relationship of V2>V1.

The molten protrusion 95 is fixed as the die 96 is cooled after being molded. The thermal caulking portion 94 after the thermal caulking has an overlap portion 94*a* overlapping with the memory portion 30 in terms of the lateral direction D2 and the vertical direction D3 (see FIG. 10) and has the minute gap C between the memory portion 30 in terms of the front-back direction D1. That is, the overlap portion 94*a* which is a part of the rod shape project portion overlaps with the memory portion 30 when viewed from a direction orthogonal to the surface of the memory portion 30. At this time, an overlap length r which is a length of the overlap portion 94*a* projecting to the recess portion 91 in the lateral direction D2 is set (see FIG. 10) so that the memory portion 30 does not fall out of the casing 89. If a length of the memory portion 30 is Xm and a length of the recess portion 91 is X1, it is possible to avoid the memory portion 30 from falling out of the casing 89 by setting the overlap length r so as to meet a relationship of X1−r<Xm or r>X1−Xm in the lateral direction D2. Thereby, the memory portion 30 does not fall out of the casing 89 to the rear side R and is retained freely movably within the area of the recess portion 91 in the lateral direction D2 and the vertical direction D3.

As described above, according to the image forming apparatus 1 of the present embodiment, the supporting portion 90 regulates the move of the memory portion 30 with respect to the casing 89 in terms of the respective directions D1, D2 and D3 by the bottom portion 92 of the recess portion 91 and the thermal caulking portion 94 and the side wall portion 93 of the recess portion 91. The supporting portion 90 is also integrated with the casing 89. Therefore, because the supporting portion 90 is integrated with the casing 89, it is possible to downsize the drum cartridge 80 and to make it harder to attach or remove the memory portion 30 as compared to a case of utilizing a removable separate retaining member.

In particular, the memory portion 30 is retained by utilizing the thermal caulking portion 94 in the present embodiment. Due to that, the supporting portion 90 disables to remove the memory portion 30 out of the casing 89. That is, it is necessary to destroy the thermal caulking portion 94 in order to remove the memory portion 30 and it is difficult to attach again when it is removed. This arrangement makes it possible to prevent erroneous use of the memory portion 30 in the market because the memory portion 30 cannot be readily removed out of the drum cartridge 80 and it is difficult to attach the memory portion 30 again.

By the way, a case where the memory portion 30 is pasted and fixed to the recess portion 91 of the casing 89 by a double sided tape will be examined as a comparison with the supporting portion 90 of the present embodiment. In the drum cartridge 80, the photosensitive drum 81 is rotated reversely before its rotation is stopped in ending an image forming process in order to prevent image defects from being generated due to a drum cleaner. Even though the drum cartridge 80 is positioned by fitting with the front frame plate 13 and the rear frame plate 14 of the apparatus body 10, the drum cartridge 80 has a minute fitting backlash (of around 30 μM in a radius direction for example). While the fitting backlash is gathered in one direction centering on the positioning portion of the drum cartridge 80 when the photosensitive drum 81 rotates normally, the drum cartridge 80 is rotationally moved until the backlash is gathered in a reverse direction when the photosensitive drum 81 is rotated reversely. Due to the minute rotation of the drum cartridge 80, the memory-side contact portion 33 of the memory portion 30 fixed to the casing 89 frictionally slides with the body-side contact portion 54, and the body-side contact portion 54 causes flaws on the surface of the memory-side contact portion 33. Thereby, contact failure between the memory-side contact portion 33 and the body-side contact portion 54 occurs, possibly causing communication errors between the memory portion 30 and the control unit 12.

Meanwhile, because the drum cartridge 80 of the present embodiment includes the supporting portion 90 as described above, the memory-side contact portion 33 is movable in the directions (in the lateral direction D2 and the vertical direction D3) orthogonal (intersecting with) to the contact direction of the contact point. Thereby, even when the drum cartridge 80 is moved by the reverse rotation, the contact position is maintained without relatively moving following the move of the drum cartridge 80. This arrangement eliminates the frictional slide of the memory-side contact portion 33 with the body-side contact portion 54, prevents the flaws from being generated on the surface of the memory-side contact portion 33 by the body-side contact portion 54 and makes it possible to take the contact point stably. That is, this arrangement makes it possible to stabilize the contact by preventing the friction between the memory-side contact portion 33 and the body-side contact portion 54 and to suppress contact failures.

In particular, according to the present embodiment, the second range in which the side wall portion 93 of the recess portion 91 regulates the move of the memory portion 30 is set to be larger than a degree by which the drum cartridge 80 mounted on the apparatus body 10 is movable with respect to the apparatus body 10 in the lateral direction D2 and the vertical direction D3. Thereby, even if the drum cartridge 80 moves with respect to the apparatus body 10 in maximum by backlash during operation of the image forming apparatus 1, the contact position can be maintained without causing the relative move between the memory-side contact portion 33 and the body-side contact portion 54.

Still further, according to the image forming apparatus 1 of the present embodiment, the thermal caulking portions 94 are provided at the positions abuttable with the two short sides of the rectangular memory portion 30. This arrangement makes it possible to suppress the memory portion 30 from falling down when the memory portion 30 moves within the recess portion 91 and to reduce an area overlapping with the memory-side contact portion 33 as compared to a case where the thermal caulking portions 94 are provided on the long side portions.

Figure 13:
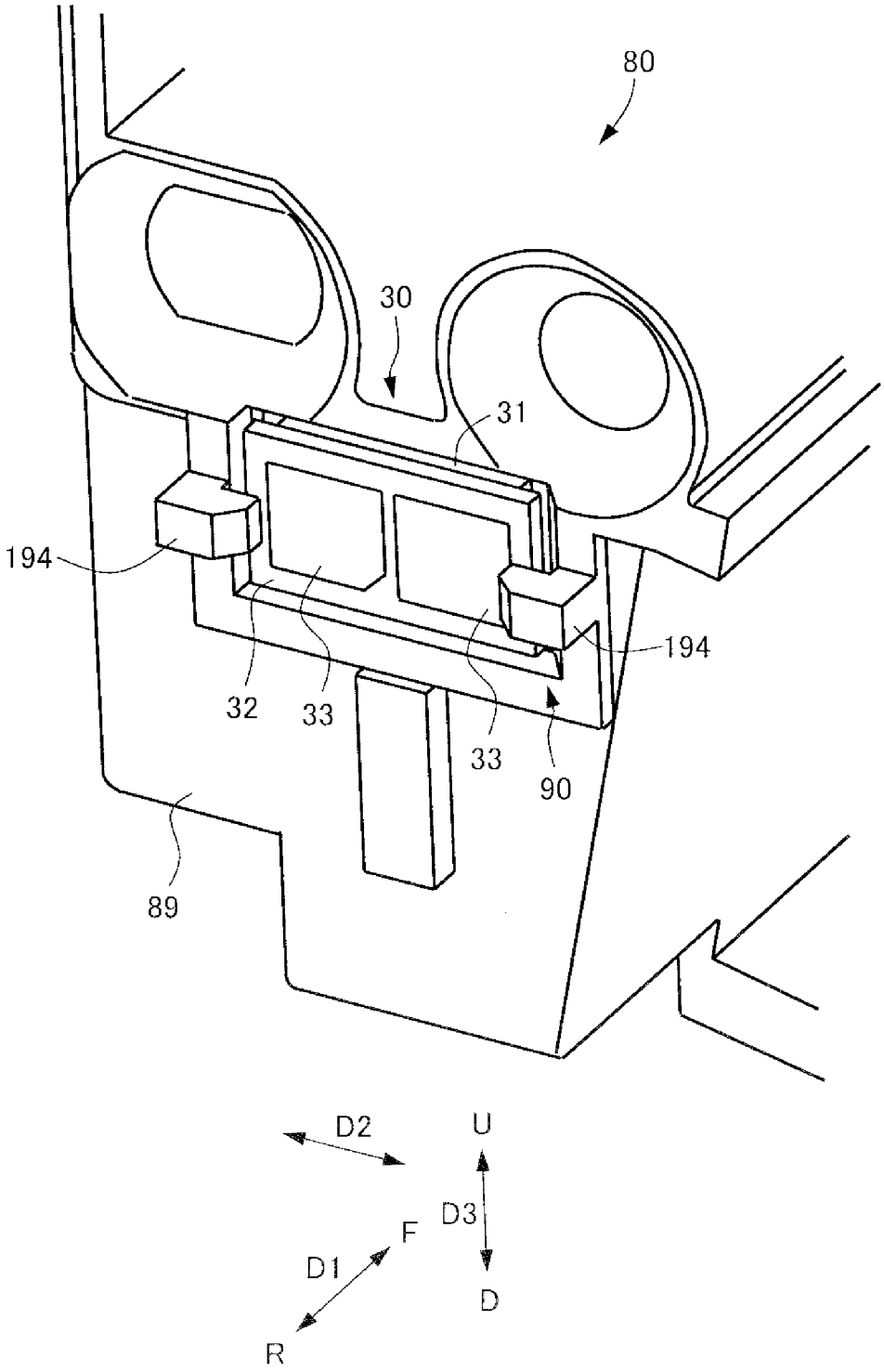
FIG. 13 is a perspective view illustrating a modified example of the memory portion of the drum cartridge of the embodiment.
Figure 14:
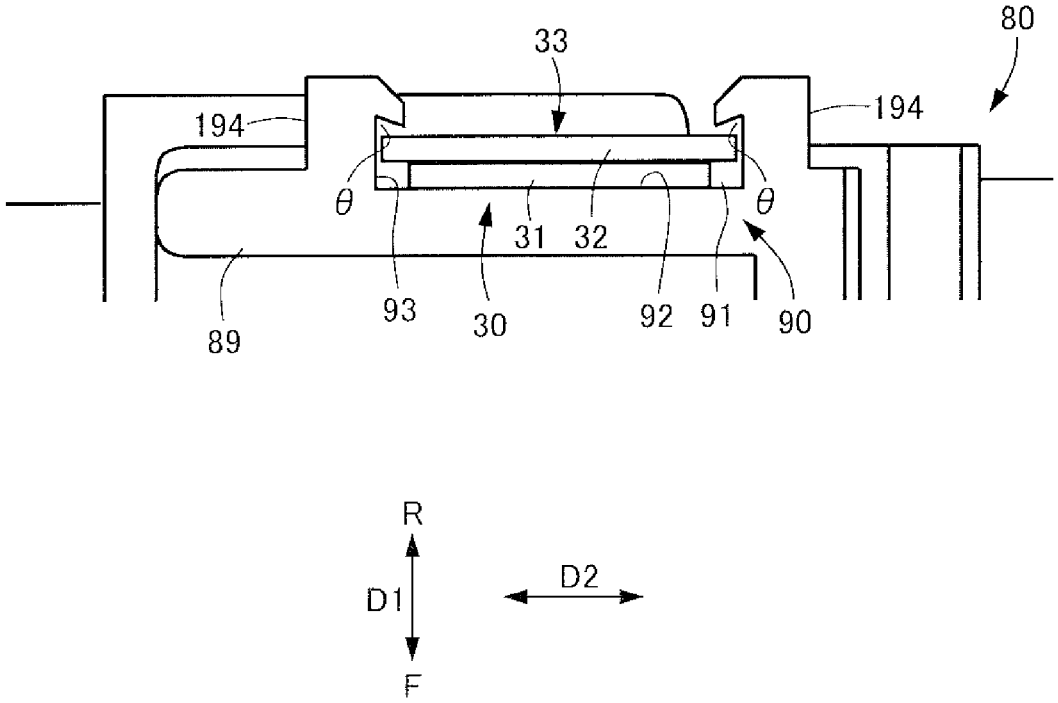
FIG. 14 is a horizontal section view illustrating the modified example of the memory portion of the drum cartridge of the embodiment.

While the case where the thermal caulking portion 94 is applied as the regulating portion has been described in the image forming apparatus 1 of the present embodiment described above, the present disclosure is not limited to such case. For instance, as illustrated in FIGS. 13 and 14, claw portions 194 integrated with the casing 89 may be also applicable as the regulating portion. In this case, the claw portion 194 is provided so as to overlap with the rear side R of the memory portion 30 embedded in the recess portion 91 and the memory portion 30 cannot be taken out of the casing 89 by the claw portion 194. It is noted that a retaining angle (θ in FIG. 14) is preferable to be an acute angle. Thereby, the memory portion 30 cannot be taken out of the casing 89 unless the claw portion 194 is destroyed. It is possible to downsize the drum cartridge 80 and to make it harder to attach or remove the memory portion 30 because the claw portion 194 is integrated with the casing 89 also when the claw portion 194 is thus applied as compared to a case of utilizing a removable separate retaining member.

While the case where the drum cartridge 80 is applied as the cartridge has been described in the image forming apparatus 1 of the present embodiment, the present disclosure is not limited to such case. For instance, the present disclosure is also applicable to other kinds of cartridges such as a developing cartridge storing a developing sleeve 24 serving as an image forming member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

This cartridge can be used as a removable cartridge applied in the electro-photographic or the electrostatic recording image forming apparatus and can be suitably used for the cartridge attached with a memory chip in particular.

As described above, it is possible to suppress contact failures from occurring between a body-side contact portion and a memory-side contact portion with a simple configuration.

What is claimed is:

1. A cartridge removably attachable to an image forming apparatus, the cartridge comprising:

a casing formed of resin;

a memory chip comprising a substrate and a first contact portion provided on the substrate, the memory chip being configured to store information to be outputted to the image forming apparatus, the first contact portion being configured to contact a second contact portion of the image forming apparatus when the cartridge is attached to the image forming apparatus;

a retaining portion provided on an outer surface of the casing and formed integrally with the casing, the retaining portion comprising a pair of first side walls facing each other in a first direction along a surface direction of the substrate and a pair of second side walls facing each other in a second direction, orthogonal to the first direction, along the surface direction of the substrate, the pair of the first side walls and the pair of the second side walls regulating the substrate from moving along the surface direction of the substrate; and a rod-shaped projecting portion formed integrally with the casing provided to project out of the outer surface of the casing, the rod-shaped projecting portion regulating the substrate from moving in a thickness direction of the substrate, wherein a part of the rod-shaped projecting portion overlaps with the substrate such that a length of the part in the second direction is shorter than a length of a first side wall and a length of the part in the first direction is shorter than a length of a second side wall when viewed from the thickness direction of the substrate.

2. The cartridge according to claim 1, wherein the retaining portion is a recess portion provided on a side surface of the casing, and wherein a recess surface of the retaining portion is defined along the side surface of the casing.

3. The cartridge according to claim 1, wherein the rod shaped projecting portion comprises a thermal caulking portion formed by thermally caulking a projecting portion provided on the casing.

4. The cartridge according to claim 1, wherein the rod-shaped projecting portion is a claw portion provided on the casing.

5. The cartridge according to claim 1, wherein the memory chip is attached to a downstream side surface in an insertion direction in which the cartridge is inserted into the image forming apparatus.

6. The cartridge according to claim 1, wherein the rod-shaped projecting portion is provided to face a short side of the memory chip.

7. The cartridge according to claim 1, wherein a plurality of rod-shaped projecting portions are provided, wherein a first projecting portion is provided to face a first short side of the memory chip, and wherein a second projecting portion is provided to face a second short side of the memory chip.

8. The cartridge according to claim 7, wherein the first projecting portion and the second projecting portion are disposed to face with each other in a longitudinal direction of the memory chip.

9. The cartridge according to claim 1, further comprising a photosensitive drum supported by the casing.

10. An image forming apparatus comprising:

the cartridge according to claim 9; and the second contact portion configured to contact with the first contact portion when the cartridge is attached to the image forming apparatus.

11. A cartridge removably attachable to an image forming apparatus, the cartridge comprising:

a casing formed of resin;

a memory chip comprising a substrate and a first contact portion provided on the substrate, the memory chip being configured to store information to be outputted to the image forming apparatus, the first contact portion being configured to contact a second contact portion of the image forming apparatus when the cartridge is attached to the image forming apparatus;

a retaining portion provided on an outer surface of the casing, formed integrally with the casing to fit the memory chip and to retain the memory chip, and regulating the substrate from moving along a surface direction of the substrate; and a regulating portion formed integrally with the casing and provided to project out of the outer surface of the casing to regulate movement of the memory chip in a thickness direction of the substrate, wherein the regulating portion is processed and formed by thermal deformation after the memory chip is attached to the retaining portion.

12. The cartridge according to claim 11, wherein the retaining portion is a recess portion provided on a side surface of the casing, and wherein a recess surface of the retaining portion is defined along the side surface of the casing.

13. The cartridge according to claim 11, wherein the regulating portion is a thermal caulking portion formed by thermally caulking a projecting portion provided on the casing.

14. The cartridge according to claim 13, wherein the thermal caulking portion is an edge of the regulating portion in a direction projecting out of the outer surface of the casing.

15. The cartridge according to claim 11, wherein the memory chip is attached to a downstream side surface in an insertion direction in which the cartridge is inserted into the image forming apparatus.

16. The cartridge according to claim 11, wherein the regulating portion is provided to face a short side of the memory chip.

17. The cartridge according to claim 11, wherein a plurality of regulating portions are provided, wherein a first regulating portion is provided to face a first short side of the memory chip, and wherein a second regulating portion is provided to face a second short side of the memory chip.

18. The cartridge according to claim 17, wherein the first regulating portion and the second regulating portion are disposed to face each other in a longitudinal direction of the memory chip.

19. The cartridge according to claim 11, further comprising a photosensitive drum supported by the casing.

20. An image forming apparatus comprising:

the cartridge according to claim 19; and the second contact portion configured to contact with the first contact portion when the cartridge is attached to the image forming apparatus.

* * * * *